US008351576B2

(12) United States Patent
Behling et al.

(10) Patent No.: US 8,351,576 B2
(45) Date of Patent: Jan. 8, 2013

(54) X-RAY TUBE WITH PASSIVE ION COLLECTING ELECTRODE

(75) Inventors: Rolf Karl Otto Behling, Norderstedt (DE); Stefan Hauttmann, Buchholz (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 178 days.

(21) Appl. No.: 12/936,990

(22) PCT Filed: Apr. 7, 2009

(86) PCT No.: PCT/IB2009/051455

§ 371 (c)(1),
(2), (4) Date: Oct. 8, 2010

(87) PCT Pub. No.: WO2009/127995

PCT Pub. Date: Oct. 22, 2009

(65) Prior Publication Data

US 2011/0038463 A1 Feb. 17, 2011

(30) Foreign Application Priority Data

Apr. 17, 2008 (EP) ..... 08103589

(51) Int. Cl.
*H01J 35/18* (2006.01)

(52) U.S. Cl. ..... 378/140

(58) Field of Classification Search ..... 378/119, 378/136, 137, 138, 140
See application file for complete search history.

(56) References Cited

U.S. PATENT DOCUMENTS

| | | | | |
|---|---|---|---|---|
| 1,483,642 | A | 2/1924 | Mutscheller | |
| 1,946,312 | A | 2/1934 | Coolidge | |
| 2,024,332 | A | 12/1935 | Bouwers | |
| 2,053,792 | A | 9/1936 | Huppert et al. | |
| 2,186,380 | A | 1/1940 | Hirsch | |
| 2,836,748 | A | 5/1958 | Atlee | |
| 3,885,179 | A | 5/1975 | Friedel | |
| 4,521,900 | A | 6/1985 | Rand | |
| 6,044,129 | A | 3/2000 | Miller et al. | |
| 6,111,933 | A * | 8/2000 | Schaaf et al. | 378/137 |
| 2006/0274889 | A1 * | 12/2006 | Lu et al. | 378/122 |
| 2007/0086571 | A1 | 4/2007 | Hempel et al. | |

FOREIGN PATENT DOCUMENTS

| | | | |
|---|---|---|---|
| EP | 0991106 | A2 | 4/2000 |
| WO | 2004097886 | A2 | 11/2004 |
| WO | 2008017982 | A2 | 2/2008 |

* cited by examiner

*Primary Examiner* — Irakli Kiknadze

(57) ABSTRACT

An X-ray tube (1) comprising a cathode (3), an anode (5) and a further electrode (7) is proposed. Therein, the further electrode is arranged and adapted such that, due to impact of 'free electrons (27) coming from the anode (5), the further electrode (7) negatively charges to an electrical potential lying between a cathode's potential and an anode's potential. The further electrode (7) may be passive, i.e. substantially electrically isolated and not connected to an active external voltage supply. The further electrode (7) may act as an ion pump removing ions from within a primary electron beam (21) and furthermore also removing atoms of residual gas within the housing (11) of the X-ray tube (1). In order to further increase the ion pumping capability of the further electrode (7), a magnetic field generator (61) can be arranged adjacent to the further electrode (7).

27 Claims, 3 Drawing Sheets

X-RAY TUBE WITH PASSIVE ION COLLECTING ELECTRODE

FIELD OF THE INVENTION

The present invention relates to an X-ray tube with an ion collecting electrode which X-ray tube may for example be used in computer tomography (CT) systems.

BACKGROUND OF THE INVENTION

X-ray tubes are for example used in CT systems wherein the X-ray tube is rotating about a patient, generating a fan-beam of X-rays, wherein opposite to the X-ray tube and with it on a gantry rotor rotates a detector system which converts the attenuated X-rays into electrical signals. Based on these electrical signals, a computer system may reconstruct an image of the patient's body.

In the X-ray tube, a beam of primary electrons emitted from a cathode hits a focal spot of an anode and creates X-rays. However, a percentage of the incoming primary electrons is backscattered or creates recoil electrons, these electrons being hereinafter commonly referred to as back-directed electrons. Thereby, it is converted to a current of back-directed electrons leaving the focal spot and carrying approximately 40% (W-target) of the energy of the primary beam away.

Some conventional tube designs have the cathode directly in front of the anode. Accordingly, a strong electrical field is established between the negative cathode and the positive anode. In such tube designs, due to mirror effects caused by the positively charged anode, a lot of back-directed electrons are redirected again to the anode which is thereby heated in an undesired way and which furthermore creates undesired off-focal radiation from areas spaced apart from the focal spot where the back-directed electrons impact onto the anode.

In an improved recent approach, such undesired heating and off-focal radiation can be effectively reduced by improving the X-ray tube in such a way that the back-directed electrons are allowed to travel in a nearly field-free space towards collector electrodes. So, most of the 40% of the heat loading of the anode may be avoided and also most of the off-focal radiation may be avoided.

However, there may arise problems due to ions created from residual gas or target vapour in the intense primary beam and in the shower of back-directed electrons. In earlier X-ray tube designs in which a strong electrical field is created between the anode and the cathode, such ions are attracted by the electrical field towards one of the electrodes, usually the cathode. However, in recent X-ray tube designs having nearly field-free spaces, the ions may no longer experience a strong electric pull field. Accordingly, there is no relevant ion pump active anymore, as in former designs, where large amounts of ions were implanted into the cathode and removed from the vacuum within the X-ray tube.

Accordingly, X-ray tubes with a long nearly field-less drift path of the useful electron beam, where the electrostatic field in the vicinity of a major part of the useful electron beam for the generation of X-rays is smaller than the dynamic field generated by the beam space charge, may suffer from substantial ion concentrations in the electron beam which may de-stabilize its focusing.

SUMMARY OF THE INVENTION

There may be a need to provide an X-ray tube which at least partially overcomes the above-mentioned problems. Particularly, there may be a need to provide an X-ray tube wherein ions generated within the X-ray tube may be effectively collected and removed from a drift path of the primary electron beam, particularly from a nearly field-less drift path. Furthermore, there may be a need to provide an X-ray tube which is simple in construction thereby reducing manufacturing and maintenance costs.

According to an aspect of the present invention, an X-ray tube is provided, the X-ray tube comprising a cathode, an anode and a further electrode. Therein, the further electrode is arranged and adapted such that, due to impact of free electrons, the further electrode negatively charges up to an electrical potential lying between a cathode's potential and an anode's potential.

It may be seen as a gist of the present invention to provide, additionally to a conventional cathode-anode arrangement, a further electrode in an X-ray tube. This further electrode may be adapted to act as an ion collector or ion pump during the operation of the X-ray tube. During such operation, electrons emitted by the cathode are accelerated towards the anode. When impacting onto the anode, recoil electrons or backscattered electrons may be emitted from the anode. The further electrode may be arranged at a location within the X-ray tube such that such free recoil electrons may impact onto the further electrode. Due to such impact of free electrons, the further electrode negatively charges. The further electrode shall furthermore be arranged and adapted such that an electrical potential to which the further electrode is charged due to the impacting free electrons lies between the potential of the cathode and the potential of the anode during operation of the X-ray tube.

In this context it may be important to emphasize that the electrical potential to which the further electrode is charged during the operation of the X-ray tube is mainly due to, i.e. depends on, the impact of free electrons onto the further electrode. In other words, the balanced negative potential of the further electrode, i.e. the electrical potential which is achieved after the X-ray tube system has come from start up conditions to balanced continuous use conditions, is mainly determined, on the one hand, by the flow of free electrons impacting onto the further electrode and, on the other hand, by the net loss of charges e.g. by way of electron emission from the further electrode and ions collected. Again in other words, the further electrode can be referred to as a passive, self-charging electrode.

According to an embodiment of the present invention, the further electrode is not electrically connected to an external voltage supply. In other words, the further electrode is substantially electrically isolated and passive. For example, the further electrode is neither electrically connected to a housing of the X-ray tube or to the anode of the X-ray tube nor to an additional control unit for establishing a predetermined or selectable electrical potential to the further electrode by applying an external voltage. The insulation may not be perfect. I.e. it may have limited linear (ohmic) or non-linear electrical resistive characteristics, e.g. using a thin layer metallic surface coating on ceramics.

In this context, the term of lacking electrical connection between the further electrode and an external voltage supply and/or other components of the X-ray tube may be interpreted in such a way that there is no electrically conductive element provided between the further electrode and a voltage supply or an X-ray tube element. Particularly, there may be no electrical conductor or wiring towards the further electrode. Accordingly, the further electrode, upon impact of free electrons, will charge up to a specific balanced electrical potential. However, the "lacking electrical connection" shall not be interpreted as excluding the possibility that charges are released from the further electrode by other ways than conventional electrical conductors such as for example by way of cold or hot electron emission where electrons are emitted from a surface of a further electrode into a surrounding gas or vacuum.

The balanced electrical potential to which the further electrode charges during X-ray tube operation due to impact of free electrons may be well below the negative electrical potential of the cathode, for example closer to the electrical potential of the anode than to the electrical potential of the cathode. For example, this balanced electrical potential may be between 1 and 30%, preferably between 3 and 10%, of the potential difference between the anode and the cathode. For example, if the cathode potential is −120 kV and the anode potential is 0 kV, the further electrode may be arranged and adapted such that its balanced electrical potential establishes at approximately −5 kV.

Due to its balanced negative electrical potential, the further electrode may act as an ion collector or ion pump attracting positively charged ions in its surrounding. Accordingly, ions created in the surrounding space by collision of vapour molecules with electrons of the primary electron beam or with back-directed electrons experience an electric field and may be quickly pulled out of the vacuum space towards the further electrode where they may be buried in the bulk material. Such ion pump may act more efficient than other conventionally known ion pumps based for example on chemical getters.

According to a further embodiment of the present invention, the X-ray tube further comprises a housing part wherein the housing part is adapted to be kept on a predetermined electrical potential and wherein the further electrode is arranged at a position and in a distance to the housing part such that, during operation of the X-ray tube, on the one hand, the further electrode's negative potential tends to increase due to electrons coming from the anode and impacting onto the further electrode and, on the other hand, such that the further electrodes negative potential tends to decrease due to electrons emitted from the further electrode towards the housing part.

The housing part may be an entire housing or part of such entire housing enclosing elements of the X-ray tube such as the cathode, the anode and the further electrode. The housing part may be made of an electrically conductive material such as a metal. The housing part may be kept on the predetermined electrical potential by way of electrical connection to an external voltage supply. Alternatively, the housing part can be electrically connected e.g. to the anode thereby being on the same electrical potential as the anode.

Especially in the later case where the housing part and the anode are on the same electrical potential, the housing part may be designed such as to mainly enclose a portion of the X-ray tube comprising the anode and the further electrode wherein in this portion of the X-ray tube, the main electrical field between the cathode and the anode and/or the housing part is shielded away. Thereby, a nearly field-less region can be established within the X-ray tube. In this nearly field-less region, for example a field-less drift path can be established wherein electrons coming from the cathode and being accelerated towards the anode do not experience a significant electrical field arising from the potential difference between the anode and the cathode. Particularly, if the further electrode is arranged in such nearly field-less region, it can establish a comparatively low electrical field within this nearly field-less region which low electrical field attracts ions generated in this nearly field-less region towards the further electrode.

According to a further embodiment of the present invention, the further electrode is electrically isolated against the housing part by an insulating element wherein the insulating element has limited electrical conductivity which is adapted such that, under balanced operating conditions of the X-ray tube, an electrical current from the further electrode to the housing part through the insulating element is smaller the flow of charges coming from the anode and impacting onto the further electrode. In such arrangement, the further electrode will charge to a specific negative potential due to impacting electrons although a small current through the insulating element will induce a loss of negative charges. A typical electrical resistivity of the insulating element may be larger than 1 Meg Ohm.

According to a further embodiment of the present invention, the further electrode comprises an emission surface area which is adapted for field emission of electrons.

Electrons need to have a minimum potential energy or a minimum kinetic energy in order to be able to be released from a surface of a specific material. This energy is also referred to as the material's work function.

As an example, this energy can be provided in the form of thermal energy. An electrode can be heated to such a temperature that electrons within the electrode have sufficient kinetic energy to be able to leave the electrode material. This is also referred to as the principle of the hot cathode.

On the other hand, in case, a strong electrical field is present in the neighbourhood of the electrode's surface, the potential electron energy can be reduced. Electrons will be able to tunnel through the surface potential barrier, following a Fowler-Nordheim relationship between emission current and electrical field. For this purpose, and to enhance the current, the surface geometry of the electrode can be adapted in such a way that the microscopic electric field is increased locally such that electrons can leave the electrode material at corresponding locations. For example, the surface of the electrode can be provided with small tips, e.g. tungsten tips, wherein at the tip end, the electric potential is strongly increased and electrons can be emitted from such tip end. Electron emission due to such locally increased electric field by way of specific surface geometries is frequently called "field emission" or "cold emission" of electrons.

Therein, the magnitude of the electron current emitted from the electrode surface strongly depends, on the one hand, on the macroscopic electric field due to the electrode potential with respect to a corresponding reference potential, such as e.g. the potential of the adjacent housing part of the X-ray tube, and, on the other hand, on the local microscopic field which may be modified due to the surface geometry of the electrode. For example, given the right size of the emission surface area, it has been found that a distance of approximately 1 mm between the emission surface area of the electrode being at approximately −5 kV and an adjacent reference potential area of a housing part being at 0 kV may exactly balance the incoming current of scattered electrons in a specific X-ray tube.

According to a further embodiment of the present invention, the emission surface area of the further electrode comprises carbon nanotubes (CNTs). For example, the emission surface area may be coated with carbon nanotubes thereby creating a microscopically rough surface structure with nano tubes forming sharp edges at which the electric field may be locally increased. Carbon nanotubes may be particularly beneficial, as their field emission current density may be relatively high and the stability against local overheating of the tips and self-destruction is high as well.

According to a further embodiment of the present invention, the further electrode is arranged adjacent to a nearly field-less drift path between the cathode and the anode of the X-ray tube.

The negatively charged further electrode may attract positively charged ions created for example by the primary electron beam within the nearly field-less drift path, thereby stabilizing the focusing of the primary electron beam. The term "adjacent to a nearly field-less drift path" may herein be interpreted in a way that the further electrode is arranged at a location and at a distance from the drift path of the primary electron beam between the cathode and the anode such that the attraction force due to the negative charge of the further electrode is sufficiently high to attract a substantial portion of the ions generated within the drift path and direct them towards the further electrode. Thus, the further electrode may act as an ion collector. In practice, the distance between the further electrode and the field-less drift path may be in the range of a few millimeters.

According to a further embodiment, the further electrode is arranged adjacent to a focal spot where electrons coming from the cathode impact onto the anode. When arranged close to the focal spot at the anode, the further electrode may advantageously remove ions from a volume surrounding such focal spot thereby helping in stabilizing the focusing of the primary electron beam. Furthermore, recoil electrons or backscattered electrons emitted from the focal spot can easily reach the further electrode thereby charging it to the desired electrical potential.

In the above-mentioned aspects and embodiments, the further electrode may act as a "pull electrode" serving as a "potential converter". Whereas the kinetic energy of ionizing electrons within the primary electron beam may be for example 100-120 keV, electrons emitted from the further electrode for example by field emission may have an energy of 0-5 keV, depending on the point in space, where the ionization process takes place. As the ionization cross-section is an order of magnitude higher in this lower energy range compared to the high energy range, the efficiency of ionization of residual gas within the X-ray tube when the current of electrons of moderate energy passes through the vacuum within the X-ray tube is greatly enhanced. In other words, atoms or particles of residual gas within the X-ray tube can be efficiently ionized by the low energy electrons emitted from the further electrode e.g. by field emission and the created ions can be attracted, i.e. "pumped", e.g. towards the further electrode which thereby acts as an ion pump.

According to a further embodiment of the present invention, the X-ray tube further comprises a magnetic field generator adapted for generating a magnetic field adjacent to the further electrode.

Due to the magnetic field generated by such magnetic field generator, electrons emitted from the further electrode may be forced on bent and therefore elongated electron paths. For example, electrons emitted from an emission surface area of the further electrode in a direction towards a housing part of the X-ray tube may be forced on a helical path. Thereby, the path electrons have to travel through the vacuum within the X-ray tube is elongated thereby increasing the probability of collision between electrons and atoms of residual gas within the X-ray tube. Accordingly, the ion creation and thereby the pump efficiency of the further electrode can be increased.

The magnetic field generated by the magnetic field generator may provide a further advantage: Ions are much heavier than electrons. For example, the mass of an ion is approximately 3 orders of magnitude larger than the mass of an electron. As a result thereof, the deflecting influence of a magnetic field on moving ions is much smaller than on electrons moving with the same velocity. This characteristics may be used in the way such that the drift path of electrons emitted from the further electrode may be heavily bent by a magnetic field whereas ions generated by collision of such electrons with non-charged particles are deflected by the magnetic field much less while travelling towards the attracting further electrode. As a result thereof, the location where the ions will impact onto the surface of the further electrode will be spaced apart from the surface area from which the electrons are emitted at the further electrode. Using this effect, it can be prevented that ions impact onto the emission surface area for field emission of electrons. This can significantly increase the lifetime of the further electrode as this emission surface area is usually highly sensitive and easily damaged by ion bombardment.

According to a further embodiment of the present invention, a partial surface area of the further electrode is coated with a chemical getter material. Upon impact, ions will be neutralized and buried in a layer of material which forms a chemical compound with these atoms.

According to a further embodiment of the present invention, the partial surface area coated with the ion getter material is located adjacent to an emission surface area which is adapted for field emission of electrons. As outlined further above, the ions generated by electrons emitted from an emission surface area of the further electrode impact onto the further electrode at positions spaced apart from the position of the emission surface area. It may therefore be advantageous to design the further electrode in such a way that parts of the surface of the further electrode are adapted for field emission of electrons whereas adjacent parts of the surface area of the further electrodes where ions are assumed to impact are coated with an ion getter material. Thereby the ion pump efficiency of the further electrode may be further increased.

It has to be noted that aspects, embodiments and features of the invention have been described with reference to different subject-matters. In particular, some features and embodiments have been described with reference to the X-ray tube itself whereas other features and embodiments have been described with respect to its operation or use. However, a person skilled in the art will gather from the above and the following description that, unless other notified, in addition to any combination or features belonging to one type of subject-matter also any combination between features relating to different subject-matters is considered to be disclosed with this application.

The aspects and embodiments defined above and further aspects of the present invention may be apparent from exemplary embodiments to be described hereinafter with reference to the drawings but to which the invention is not limited.

BRIEF DESCRIPTION OF THE DRAWINGS

It is to be noted that the drawings are only schematic and not to scale. Furthermore, similar reference signs designate similar elements throughout the drawings.

DETAILED DESCRIPTION OF THE EMBODIMENTS

Figure 1:
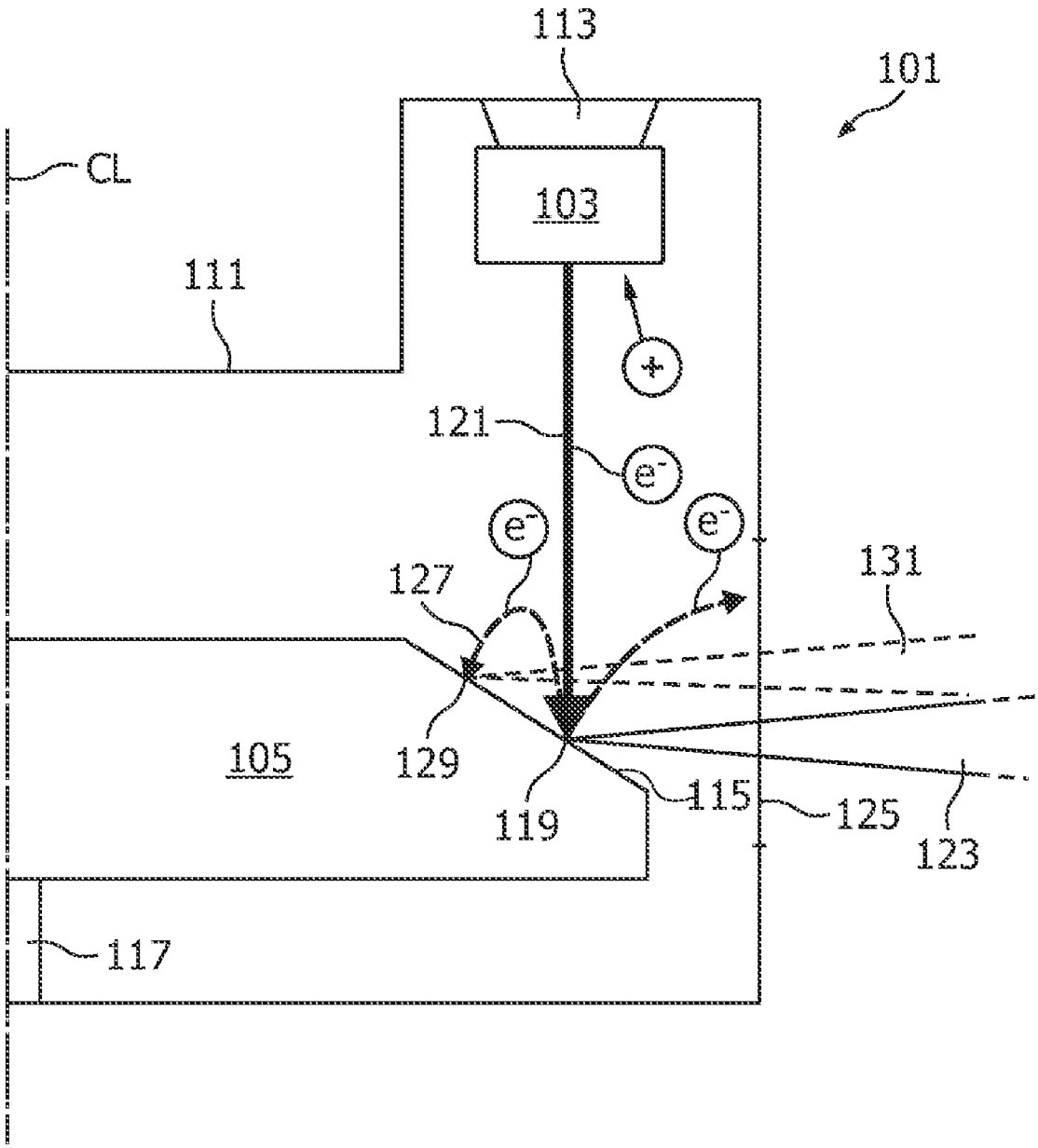
FIG. 1 (prior art)
FIG. 1 shows a conventional X-ray tube.

FIG. 1 shows a conventional X-ray tube 101 comprising as main components a cathode 103 and an anode 105. The components of the X-ray tube 101 are enclosed by a housing 111. The cathode 103 is set to a highly negative potential of for example −120 kV and is mechanically attached to the housing 111 by an electrically insulating element 113 such that the cathode 103 is electrically isolated against the housing 111. The anode 105 is designed as round disk which can be rotated around a rotation axis 117. The anode 105 comprises a slanted surface 115. Electrons ($e^-$) of a primary electron beam 121 emitted from the cathode 103 and accelerated towards the anode 105 impact onto the anode 105 in a focal point 119 on the slanted surface 115.

Upon such impact of electrons, a portion of approximately 60% of the electron beam 121 directed onto the anode 105 serves for generating a beam of X-rays 123. This beam of X-rays 123 can be transmitted through a window 125 within the housing 111 in a direction towards an object to be examined.

However, a rest portion of approximately 40% of the electron beam 121 will be converted into recoil electrons flying in a direction away from the anode 105. These back-directed electrons 127 will be attracted by the positive electrical potential of the anode 105 or of the housing 111. The thus deflected back-directed electrons 127 may impact onto the surface of the anode 105 at a location 129 spaced apart from the focal point 119 thereby, on the one hand, generating off-focus X-ray radiation 131 and, on the other hand, generating substantial heat within the anode 105.

Figure 2:
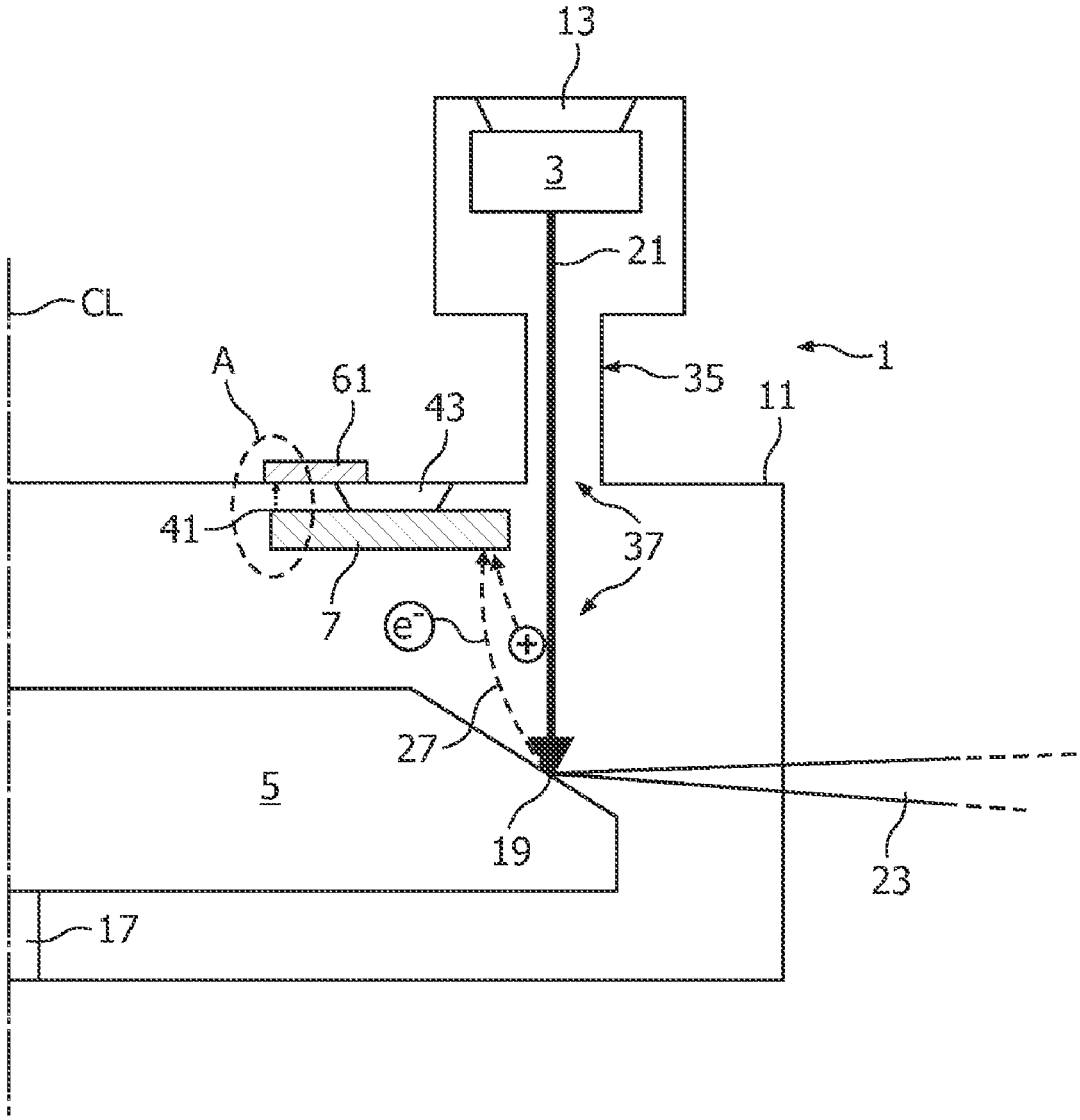
FIG. 2 shows an X-ray tube according to an embodiment of the invention.

It is to be noted that in the FIGS. 1 and 2, only a portion of the X-ray tube 101 is shown up to a centreline (CL). The centreline (CL) can be interpreted as the symmetry axis of the anode 105 in which symmetry axis the rotation axis 117 of the anode can be located.

FIG. 2 shows an embodiment of an X-ray tube 1 according to the present invention. The X-ray tube 1 comprises a cathode 3 and an anode 5 arranged within a housing 11. The cathode 3 is mechanically connected to the housing 11 but electrically isolated against the housing 11 by an insulating element 13. The disk-shaped anode 5 can be rotated around a rotation axis 17.

In the specific embodiment shown in FIG. 2, the X-ray tube 1 is of the so-called single ended tube type. This means that, while the cathode 3 is set to a strongly negative electrical potential of for example −120 kV, the anode 5 is set to ground potential, i.e. 0 kV. Furthermore, the housing 11 is electrically connected to the anode 5 such that also the housing 11 is set to ground potential. Furthermore, the housing 11 is adapted such that it essentially encloses the anode 5 and such that only a small passage 35 is provided as a connection between the cathode 3 and the anode 5. Through this "bottleneck" 35, a primary electron beam 21 emitted by the cathode 3 can pass in a direction towards a slanted surface 15 of the anode 5 such as to generate an X-ray beam 23 emitted from a focal point 19.

Due to the specific structure of the housing 11 comprising the "bottleneck" 35, there exists a nearly field-less region 37 beginning approximately at the upper end of the "bottleneck" 35 and extending down to a proximity of the anode 5. In this nearly field-less region 35, the electrostatic field in the vicinity of a major part of the primary electron beam 21 is smaller than the dynamic field generated by the beam space charge.

As in conventional X-ray tubes, upon impact of the electron beam 21 onto the anode 5 in the focal point 19, recoil electrons 27 are generated. However, as these electrons 27 are generated within the nearly field-less region 37, these electrons 27 are not attracted by the anode 5 being at ground potential. Instead, due to their high kinetic energy, these electrons 27 may fly to a further electrode 7 provided adjacent to the anode 5 and near to the electron beam 21 within the nearly field-less region 37.

The further electrode 7 is made from an electrically conductive material but is mechanically attached to the housing 11 by an insulating element 43 made of an electrically insulating material. Therefore, the further electrode 7 is electrically isolated and may therefore be charged by the impacting back-directed electrons 27. As these back-directed electrons 27 may have very high energies in a range of up to the potential difference between the cathode 3 and the anode 5, i.e. in a range up to 120 keV, the further electrode could theoretically be charged up to a corresponding negative potential being somewhere between the electrical potential of the anode 5 and the electrical potential of the cathode 3.

Figure 3:
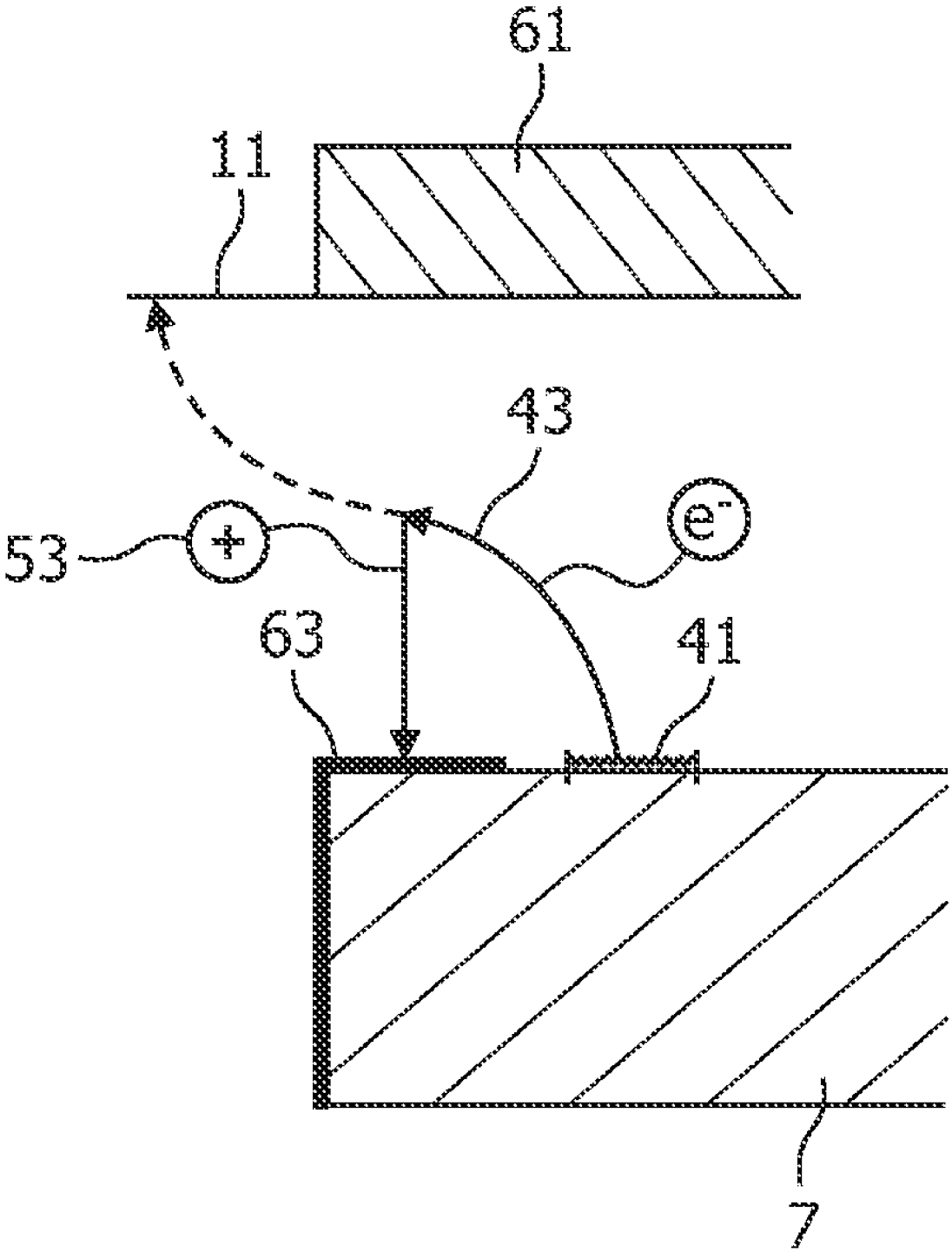
FIG. 3 shows an enlarged section A as indicated in FIG. 3.

In order to prevent excessive negative charging of the further electrode 7, the further electrode 7 is provided with an emission surface area 41 which is adapted for field emission of electrons. An enlarged view of a section A as indicated in FIG. 2 is shown in FIG. 3. The emission surface area 41 is a region of the further electrode 7 which is e.g. coated with the carbon nanotubes or provided with small sharp tips in order to locally increase an electric field between the further electrode 7 and the neighbouring part of the housing 11. Due to the macroscopic electric field arising from the potential difference between the charged up further electrode 7 and the neighbouring housing 11 and the local microscopic increase of this electrical field due to the surface structure within the emission surface area 41, electrons 43 can be emitted from the emission surface area 41 in a direction towards the housing 11. Therein, the magnitude of the current of electrons 43 emitted from the emission surface area 41 will strongly depend on the potential difference between the further electrode 7 and the housing 11. Accordingly, a balanced or steady-state potential will be established for the further electrode 7 wherein the current of electrical charges provided by back-directed electrons 27 coming from the focal point 19 of the anode 5 is of the same size as the current of electrons 43 emitted from the emission surface area 41 in a direction towards the housing 11.

One effect of the further electrode 7 is to attract positively charged ions 51 which may be generated due to collisions of electrons from the primary electron beam 21 with atoms of residual gas within the vacuum enclosed by the housing 11. Such ions 51 may be pulled towards the further electrode 7 and thus be buried there. Accordingly, such ions 51 are removed from a region adjacent to the primary electron beam 21 where they otherwise might interfere with the primary electron beam 21.

Another effect of the further electrode 7 may be as follows: Electrons 43 emitted from the emission surface 41 of the further electrode 7 have a relatively low kinetic energy being at most the potential difference between the further electrode 7 and the housing 11, i.e. being in a range e.g. between 0 and 5 keV. Such low energy electrons 41 have an increased probability of collision with atoms of residual gas within the X-ray tube 1. Ions 53 generated by such collisions may then be attracted towards the negatively charged further electrode 7 which thereby, again, acts as an ion pump.

To increase this latter effect even more, a magnetic field generator 61 is provided in a region adjacent to the further electrode 7. This magnetic field generator 61 is adapted to generate an electric field within the space between the further electrode 7 and the housing 11 through which electrons 43 emitted at the emission surface area 41 pass. The generated magnetic field serves to strongly deflect the emitted electrons 43 such that they do not fly directly from the emission surface area 41 towards the housing 11 following directly the electric potential lines but such that the path of the electrons 43 is bent. Accordingly, the length and duration of flight of electrons 43 emitted at the emission surface area 41 is elongated and, therefore, the probability of collisions with residual atoms is increased. The efficiency of the further electrode 7 acting as ion pump may thereby be increased. Ions 53 generated by such electron-atom-collisions and attracted towards the further electrode 7 are, due to their high mass, only slightly deflected by the magnetic field generated by the magnetic field generator 61. Such ions 53 may fly more or less directly towards the further electrode 7 and impact on its surface at a partial surface area 63 spaced apart from the emission surface area 41. Such partial surface area 63 may additionally be coated with an ion getter material in order to further enhance the ion pumping capability of the further electrode 7. Accordingly, the sensitive emission surface area 41 is substantially protected against impact of ions 53.

Finally, features and characteristics of the present invention can be summarized as follows: An X-ray tube 1 comprising a cathode 3, an anode 5 and a further electrode 7 is proposed. Therein, the further electrode is arranged and adapted such that, due to impact of free electrons 27 coming from the anode 5, the further electrode 7 negatively charges to an electrical potential lying between a cathode's potential and an anode's potential. The further electrode 7 may be electrically isolated and not connected to an external voltage supply. The further electrode 7 may act as an ion pump removing ions 51 from within a primary electron beam 21 and furthermore also removing atoms of residual gas within the housing 11 of the X-ray tube 1. In order to further increase the ion pumping capability of the further electrode 7, a magnetic field generator 61 can be arranged adjacent to the further electrode 7.

It should be noted that the term "comprising" and similar terms do not exclude other elements or steps and the term "a" or "an" does not exclude a plurality of elements. Also elements described in association with different embodiments may be combined. It should also be noted that reference signs in the claims should not be construed as limiting the scope of the claims.

The invention claimed is:

1. An X-ray tube comprising:
a cathode;
an anode;
a further electrode;
wherein the further electrode is arranged and adapted such that, due to impact of free electrons, the further electrode negatively charges to an electrical potential, wherein the further electrode comprises an emission surface area which is adapted for field emission of electrons, wherein the emission surface area comprises carbon nanotubes.

2. The X-ray tube according to claim 1, wherein the further electrode is arranged adjacent to a focal spot were electrons coming from the cathode impact onto the anode.

3. An X-ray tube comprising:
a cathode;
an anode;
a further electrode;
wherein the further electrode is arranged and adapted such that, due to impact of free electrons, the further electrode negatively charges to an electrical potential between a cathode's potential and an anodes potential, wherein the further electrode is arranged adjacent to a nearly field-less drift at between the cathode and the anode.

4. The X-ray tube according to claim 3, wherein the further electrode is not electrically connected to any external voltage supply of said tube.

5. The X-ray tube according to claim 3, further comprising a housing part;
wherein the housing part is configured for being kept on a predetermined electrical potential; and
wherein the further electrode is arranged at a position and in a distance to the housing part such that, during operation of the X-ray tube, the further electrode's negative potential tends to increase due to electrons coming from the anode and imparting onto the further electrode and such that the further electrode's negative potential tends to decrease due to electrons emitted from the further electrode towards the housing part.

6. The X-ray tube according to claim 3, further comprising a housing part, configured for being kept on a predetermined electrical potential, said further electrode being electrically isolated against said housing part by an insulating element, said insulating element having limited electrical conductivity which is configured such that, under balanced operating conditions of said X-ray tube, an electrical current from said further electrode to said housing part through said insulating element is equal to or smaller than the flow of charges coming from said anode and impacting onto said further electrode.

7. The X-ray tube according to claim 3, wherein the further electrode comprises an emission surface area which is configured for outputting electrons via field emission.

8. The X-ray tube according to claim 3, wherein a partial surface area of the further electrode is coated with an ion getter material.

9. The X-ray tube according to claim 8, wherein the partial surface area is located adjacent to an emission surface area which is configured for directly outputting electrons into a directly adjoining gas or directly adjoining vacuum.

10. The X-ray tube of claim 8, said material residing spaced apart from an emission surface area which is configured for outputting electrons via field emission.

11. The X-ray tube of claim 3, said impact being on said further electrode.

12. The X-ray tube of claim 3, said electrical potential being a steady-state electrical potential.

13. The X-ray tube of claim 12, said steady-state electrical potential being a potential achieved, after the tube has come from startup conditions to balanced continuous use conditions.

14. The X-ray tube of claim 12, said steady-state electrical potential being unequal to a concurrent potential of said cathode, which is said cathodes potential, and unequal to concurrent potential of said anode, which is said anode's potential.

15. The X-ray tube of claim 14, said steady-state electrical potential being between the two concurrent potentials.

16. The X-ray tube of claim 12, said steady-state electrical potential being an electrical potential whose magnitude is determined, in part, by a rate of incoming charges delivered by the impacting free electrons.

17. The X-ray tube of claim 12, said steady-state electrical potential being an electrical potential whose magnitude is determined, in part, by a rate of loss of charge by emission of electrons.

18. The X-ray tube of claim 17, configured for said emission ionizing residual gas.

19. The X-ray tube of claim 17, said emission being from said further electrode and into a surrounding gas or surrounding vacuum.

20. The X-ray tube of claim 3, said further electrode being without connection to any electrical component of said tube that is a hardware connection that provides electrical connection between said further electrode and said electrical component.

21. The X-ray tube of claim 3, said free electrons being emitted from said anode.

22. The X-ray tube of claim 3, said further electrode being disposed between said anode and said cathode.

23. The X-ray tube of claim 3, said drift path being of a primary electron beam between said anode and said cathode, the adjacency of said further electrode implying that said further electrode is arranged at a location and at a distance from said drift path such that attraction force due to said electrical potential is sufficiently high to attract a substantial portion of ions generated within said drift path and direct them towards said further electrode.

24. The X-ray tube of claim 3, said further electrode being disposed at one off-axial side of a primary electron beam between said anode and said cathode.

25. The X-ray tube of claim 3, said cathode's potential being a potential of said cathode, said anode's potential being a potential of said anode, the three potentials existing simultaneously during operation of said tube, said electrical potential being between, and therefore unequal to, the other two potentials.

26. The X-ray tube of claim 3, said anode for receiving from said cathode, a primary electron beam traveling in a beam direction, the adjacency being in a direction perpendicular to said beam direction.

27. The X-ray tube according to claim An X-ray tube comprising;

a cathode;

an anode;

a further electrode;

wherein the further electrode is arranged and adapted such that, due to impact of free electrons, the further electrode negatively charges to an electrical potential between a cathode's potential and an anode's potential, further comprising a magnetic field generator configured for generating a magnetic field adjacent to the further electrode so as to increase a at length of an electron emitted from said further electrode.

* * * * *